United States Patent [19]

Newman

[11] 4,277,064

[45] Jul. 7, 1981

[54] LOTTERY NUMBER GENERATING METHOD AND APPARATUS

[75] Inventor: Thomas M. Newman, Sicklerville, N.J.

[73] Assignee: Compu-Pic Incorporated, Philadelphia, Pa.

[21] Appl. No.: 958,083

[22] Filed: Nov. 6, 1978

[51] Int. Cl.[3] ..... A63F 9/00

[52] U.S. Cl. ..... 273/138 A

[58] Field of Search ..... 273/1 E, 138 A, 139, 273/143 R, 143 C; 264/717

[56] References Cited

U.S. PATENT DOCUMENTS

| | | | |
|---|---|---|---|
| 3,281,149 | 10/1966 | Miller . | |
| 3,439,281 | 4/1969 | McGuire et al. | 273/138 A |
| 3,580,581 | 5/1971 | Raven . | |
| 3,592,473 | 7/1971 | Jernakoff | 273/138 A |
| 3,653,026 | 3/1972 | Hurley . | |
| 3,658,340 | 4/1972 | Ohki . | |
| 3,709,499 | 1/1973 | Lukens, Jr. | 273/138 A |
| 3,735,982 | 5/1973 | Gerfin . | |
| 3,770,269 | 11/1973 | Elder | 273/138 A |
| 3,799,553 | 3/1974 | Hurley . | |
| 3,819,186 | 6/1974 | Hinterstocker . | |
| 3,825,255 | 7/1974 | Kennard et al. . | |
| 3,895,807 | 7/1975 | Friedman . | |
| 3,929,338 | 12/1975 | Busch . | |
| 3,982,764 | 9/1976 | Dieball . | |
| 4,017,081 | 4/1977 | Windisch . | |
| 4,033,588 | 7/1977 | Watts . | |
| 4,034,988 | 7/1977 | Goldner et al. . | |
| 4,037,845 | 7/1977 | Hooker . | |
| 4,060,242 | 11/1977 | Huang et al. . | |
| 4,071,246 | 1/1978 | Hooker . | |
| 4,087,092 | 5/1978 | Krause et al. | 273/138 A |
| 4,121,830 | 10/1978 | Buckley | 273/139 X |

FOREIGN PATENT DOCUMENTS

| | | | |
|---|---|---|---|
| 2537594 | 3/1977 | Fed. Rep. of Germany | 273/138 A |
| 1252259 | 11/1971 | United Kingdom . | |

OTHER PUBLICATIONS

*Touch-Me Operating and Maintenance Manual;* Atari; 1974; pp. 1-8.

*Electronic Design;* "Timer Pulses Coasting to a Stop Heighten Electronic Game Realism"; Mar. 1977; p. 78.

*Popular Electronics;* "To the Electronic Races"; Dec. 1974; pp. 52-55.

*Primary Examiner*—Vance Y. Hum

*Attorney, Agent, or Firm*—Seidel, Gonda, Goldhammer & Panitch

[57] ABSTRACT

A bank of counters is clocked at a relatively high repetition frequency by a clock oscillator. Each counter separately produces a sequence of digital signals which are transmitted at the clock oscillator frequency by a latch and a decoder/driver associated with the counter to a numeric display also associated with the counter. Consequently, the digital signals produced by each counter are separately displayed at the clock oscillator frequency. This frequency is sufficiently high to prevent recognition of a number on the display. A bank of manually operable momentary switches is associated with each latch. A brief audible tone is produced whenever a switch is operated. When operated, the switch temporarily disables the associated latch for a preselected interval of time. When disabled, the latch transmits only the digital signal currently stored in the latch to the display for the preselected interval of time. The preselected interval of time is sufficiently long to allow operator recognition of the number displayed. During the preselected interval of time, each counter continues to produce its sequence of digital signals. At the end of the preselected interval of time, the latch automatically resumes transmission of the digital signals produced by the associated counter to the display at the clock oscillator frequency.

14 Claims, 1 Drawing Figure

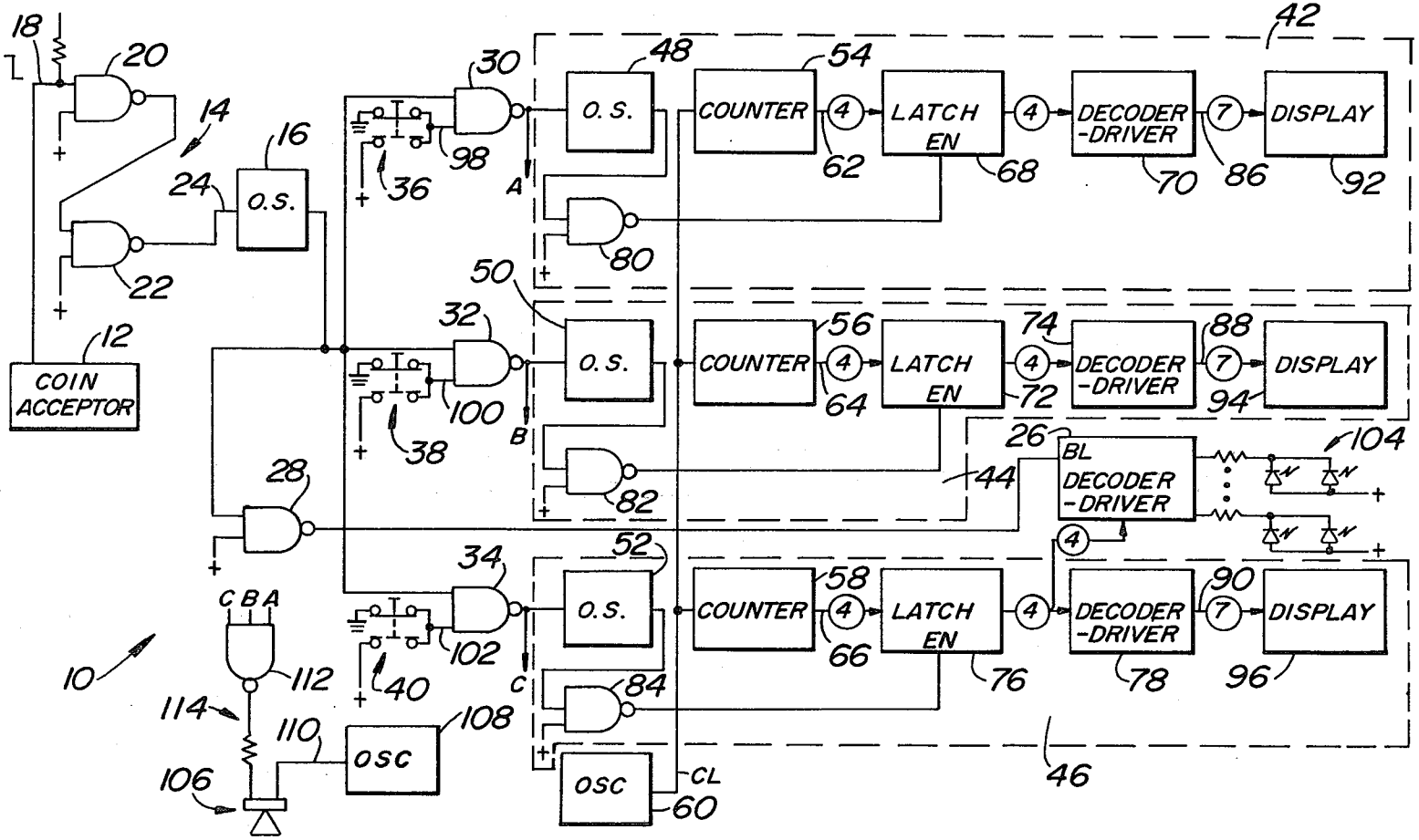
DISPLAY
DECODER -DRIVER
LATCH EN
COUNTER
O.S.
OSC
COIN ACCEPTOR
BL
CL
A
B
C
CBA

LOTTERY NUMBER GENERATING METHOD AND APPARATUS

BACKGROUND OF THE INVENTION

The present invention is directed to a lottery number generator. In particular, the invention is directed to a lottery number generator wherein plural sequences of numbers are rapidly displayed such that the numbers produce a "dancing" visual effect. By "dancing" effect, it is meant that the numbers are displayed sequentially at a sufficiently high rate to prevent visual recognition of an individual number. Each one of a plurality of displays can be stopped temporarily by means of a manually operable momentary switch associated with the display so that a particular number can be recognized on the display. Because the rate of display of the "dancing" numbers is relatively high, the operation of the switch cannot be visually coordinated with the rate of display, thereby "randomizing" the selection of a number on each display.

Preferably, three separate displays are employed to provide a three digit decimal number. The displays are stopped in sequence by operation of a bank of three momentary switches associated with the three displays. The "randomized" three digit number selected by operation of the three switches may be subsequently entered in any well-known lottery game.

Other numbers having more or less than three digits may also be selected by the invention by using the appropriate number of displays.

Various types of number generators are well-known. For example, see U.S. Pat. No. 4,087,092 wherein a number generator comprises a bank of counters which generate multiple "dancing" digits on a display. The number generator is controlled by a lottery ticket validation circuit, and a number produced by the generator is displayed when the ticket is validated.

U.S. Pat. No. 4,087,092 also discloses a form of number generator wherein the aforementioned counters are dispensed with. In this form of number generator, control is exercised by the ticket validation circuit such that a multiple digit number produced by the generator is displayed when a ticket is validated.

In either number generator disclosed in U.S. Pat. No. 4,087,092, the digits of a "random" number cannot be separately selected.

Another type of number generator is disclosed in U.S. Pat. No. 3,770,269. In this patent, the number generator generates a sequence of numbers for display. Apparently, the numbers are generated at a sufficiently slow rate to enable visual recognition of each number. All digits in the display are stopped upon successive depressions of start and stop buttons. The digits are not separately controlled by the operator.

Other patents which may be of interest are U.S. Pat. Nos. 3,709,499 and 3,592,473 which disclose electronic dice games wherein multiple displays are operated by a single switch.

An advantage of the invention is that the digits of a multiple digit display are separately selected in sequence to simulate the "random" selection of a multiple digit number for use in a lottery game.

Another advantage of the invention is that each digit of the display can be temporarily halted for different preselected intervals of time.

Further advantages of the invention appear hereinafter.

BRIEF SUMMARY OF THE INVENTION

Each of the digits of a multiple digit display are separately clocked at a relatively high frequency to prevent visual recognition of the digits. A manually operable switch is associated with each digit of the display to enable the "random" selection of each digit of the display by temporarily halting each digit in sequence over preselected intervals of time which may vary from digit to digit. For each display, a counter generates a sequence of digital signals at a relatively high frequency which are transmitted through a latch to the display. Each latch is separately controlled by a manually operable momentary switch which temporarily disables the latch for a preselected interval of time so that the latch only transmits one number of the sequence of numbers produced by the associated counter when a switch is operated.

For the purpose of illustrating the invention, there is shown in the drawing a form which is presently preferred; it being understood, however, that this invention is not limited to the precise arrangements and instrumentalities shown.

The drawing is a block diagram of the lottery number generator constructed in accordance with the principles of the present invention.

DETAILED DESCRIPTION OF THE INVENTION

Referring to the drawing, there is shown a lottery number generator 10 for producing a multiple digit number. In the commercial embodiment of the invention disclosed herein, a conventional coin acceptor circuit 12 controls a pair of NAND gates 14 and a triggerable one shot 16 to prevent operation of the generator 10 unless one or more coins of desired amount have been received by the coin acceptor mechanism.

The coin acceptor mechanism may be a ABT push-type acceptor provided with a switch circuit for producing a transition in voltage at the input 18 of the NAND gate 20. The change in voltage at the input 18 of NAND gate 20 causes the NAND gate 20 to enable NAND gate 22. Accordingly, a change in voltage is produced at the trigger input 24 of one shot 16. As a result, one shot 16 generates a pulse of T0 seconds in length at the inputs 26 of NAND gates 28, 30, 32 and 34. This pulse is inverted by NAND gate 28 which controls a decoder/driver 26 described more fully hereinafter.

The pulse generated by one shot 16 enables the NAND gates 30, 32 and 34 whose outputs are determined by a bank of manually operable momentary push-button switches 36, 38 and 40. Switch 36 is associated with NAND gate 30. Switch 38 is associated with NAND gate 32. And switch 40 is associated with NAND gate 34.

NAND gates 30, 32 and 34 are enabled for T0 seconds by the pulse appearing at the output of one shot 16. During the time interval of T0 seconds, the switches 36, 38 and 40 must be operated in succession to affect the output of NAND gates 30, 32 and 34. At the expiration of the T0 second time interval, the NAND gates 30, 32 and 34 are disabled by the output of one shot 16.

The NAND gates 30, 32 and 34 separately control display digit channels 42, 44 and 46 respectively. The display digit channels 42, 44 and 46 are basically the same, differing only in the timing of the one shots 48, 50 and 52 as described hereinafter. In the preferred embodiment of the invention described herein, the one shots 48, 50 and 52, when triggered, produce pulses which are T1, T2 and T3 seconds in length, respectively. It should be understood, however, that the durations of the pulses produced by the one shots 48, 50 and 52 may be made the same without exceeding the spirit or scope of the invention.

Referring to display digit channels 42, 44 and 46, decade counters 54, 56 and 58 are simultaneously clocked by a clock oscillator 60 which generates a clock signal CL having a relatively high repetition frequency preferably between approximately 10 KHz and 100 KHz. The clock oscillator 60 is a conventional element which may be provided with a potentiometer control (not shown) for varying the repetition frequency of the clock signal if desired. As described more fully below, the repetition frequency of the clock signal CL produced by the oscillator 60 is chosen to produce a "dancing" number display whose digits cannot be visually recognized.

Each of the decade counters 54, 56 and 58 is arranged to repetitively generate a sequence of 4-bit BCD signals 62, 64 and 66, respectively. In particular, the sequence of digital signals repeated by each counter is a BCD count sequence from 0–9. Within each sequence, the digital signals generated by each counter are generated at the repetition frequency of the clock oscillator 60.

The sequence of digital signals generated by counter 54 is transmitted by a latch 68 to a BCD-to-7-segment decoder/driver 70. The digital signals generated by counter 56 are transmitted by a latch 72 to a BCD-to-7-segment decoder/driver 74. And the digital signals generated by counter 58 are transmitted by a latch 76 to a BCD-to-7-segment decoder/driver 78.

The enable input (EN) of the latch 68 is controlled by a latch control circuit in the form of the one shot 48 and a NAND gate 80. The enable input (EN) of the latch 72 is controlled by a latch control circuit in the form of the one shot 50 and a NAND gate 82. And the enable input (EN) of the latch 76 is controlled by a latch-control circuit in the form of the one shot 52 and a NAND gate 84.

Prior to insertion of a coin in the coin acceptor mechanism 12, the outputs of one shots 48, 50 and 52 are at binary "0"s, and the NAND gates 80, 82 and 84 maintain the enable inputs of latches 68, 72 and 76 at binary "1"s. Accordingly, latches 68, 72 and 76 transmit the digital signals continuously produced by counters 54, 56 and 58, respectively, to decoder/drivers 70, 74 and 78 at the repetition frequency of the clock oscillator 60.

The decoder/drivers 70, 74 and 78 generate 7-bit digital signals 86, 88 and 90, respectively. The digital signals 86, 88 and 90 are transmitted to 7-segment LED displays 92, 94, 96, respectively. Each of the displays 92, 94 and 96 displays a decimal number from 0–9. The numbers displayed by displays 92, 94 and 96 will "dance" at the repetition frequency of the clock oscillator 60. The repetition frequency of the clock oscillator, therefore, is chosen so that the digits displayed by displays 92, 94 and 96 cannot be visually recognized.

Assuming that one or more coins of proper amount have been validated by the coin acceptor mechanism 12, the one shot 16 simultaneously enables NAND gates 30, 32 and 34 for a time interval of T0 seconds, as already explained. During this time interval, the operator must operate switches 36, 38 and 40 in succession, in any order, to select three numbers in succession from displays 92, 94 and 96. Unless all three switches 36, 38 and 40 are actuated during the T0 second time interval, all three numbers cannot be obtained.

In the drawing, switches 36, 38 and 40 are shown in solid lines in the passive positions. To actuate a switch, the switch is depressed to the position shown in broken lines. Assuming that switch 36 is actuated first, actuation of the switch will produce a binary "1" at the input 98 of NAND gate 30. In response, NAND gate 30 produces a signal which triggers the one shot 48. The one shot 48 produces a pulse T1 seconds in length which pulse is inverted by NAND gate 80 to disable the latch 68 for the T1 second interval. While the latch 68 is disabled, the counter 54 continues to generate the sequence of signals 62 at the repetition frequency of the clock oscillator 60. The latch 68, however, only transmits the digital signal stored in the latch at the moment that the latch is disabled by NAND gate 80. Accordingly, display 92 displays the decimal number corresponding to the signal stored in latch 68 during the T1 second interval.

At the end of the T1 second interval, NAND gate 80 again enables latch 68 to transmit the digital signal 62 generated by counter 54 to the display 92. The display 92, therefore, resumes the display of the "dancing" numbers at the repetition frequency of the clock oscillator 60.

Assuming that the switch 38 is actuated next, preferably prior to expiration of the T1 second interval, the NAND gate 32 will trigger one shot 50. In response, one shot 50 produces a pulse T2 seconds in length which pulse is inverted by the NAND gate 82 to disable latch 72. Accordingly, latch 72 only transmits the digital signal stored in the latch at the moment that the latch is disabled. Display 94, therefore, displays the decimal number corresponding to the signal stored in the latch during the T2 second time interval. During this time interval, however, counter 56 continues to generate the sequence of digital signals 64 at the repetition frequency of the clock oscillator 60. After termination of the T2 second time interval, the NAND gate 82 enables latch 72 to transmit the digital signal 64 to the display 94 at the repetition frequency of the clock oscillator. Display 94, therefore, resumes display of the "dancing" numbers at the repetition frequency of the clock oscillator.

Upon actuation of the switch 40, preferably prior to expiration of the T1 and T2 intervals, NAND gate 34 triggers one shot 52. In response, one shot 52 produces a pulse T3 seconds in length. This pulse is inverted by NAND gate 84 to disable the latch 76 for the T3 second interval. Accordingly, the display 96 displays the decimal number corresponding to the digital signal stored in latch 76 at the moment that the latch is disabled. The display 96 displays this number for the duration of the T3 second interval. At the end of the T3 second interval, the NAND gate 84 enables latch 76 and display 96 displays the "dancing" numbers at the repetition frequency of the clock oscillator 60.

The foregoing description of the invention presumes that the switches 36, 38 and 40 are actuated with sufficient rapidity so that advent of the T1 second interval, the T2 second interval and the T3 second interval (hereinafter also referred to as the "Ti" intervals) occurs within the T0 second time interval. In other words, the description presumes that none of the switches 36, 38 and 40 (or more precisely none of the NAND gates 30, 32 and 34) have been locked out by the one shot 16. If, in fact, all of the switches 36, 38 and 40 have been successfully operated within the T0 second time interval, display 92 will display the number corresponding to the signal stored in latch 68 within the T1 second interval; display 94 will display the number corresponding to the signal stored in latch 72 within the T2 second interval; and display 96 will display the number corresponding to the signal stored in latch 76 within the T3 second interval.

Preferably, the T1, T2 and T3 second intervals are chosen so that all three intervals overlap within the T0 interval to afford the operator enough time to sequentially actuate the switches 36, 38 and 40 within the T0 interval and so that all three digits displayed by displays 92, 94 and 96 can be recognized together before the first digit selected disappears and is replaced by the "dancing" digits described above. Thus, not only must the T1, T2 and T3 second time intervals begin within the T0 time interval but, in addition, the T1, T2 and T3 second time intervals must not be so short as to prevent visual recognition of all three digits displayed by 92, 94 and 96 at the same time during the period of overlap of all three intervals. It has been found that the digits displayed by displays 92, 94 and 96 can be confortably recognized following successive actuation of the switches 36, 38 and 40 by making the T1 second interval 8 seconds long, the T2 second interval 7 seconds long, and the T3 second interval 6 seconds long.

The length of the T0 second time interval is chosen to afford the operator sufficient time to pause momentarily before operating each of the switches 36, 38 and 40 while permitting all of the switches to be actuated in sequence at a comfortable pace. It has been found that a T0 time interval of approximately 12 seconds satisfies this condition.

Although the preferred embodiment of the invention has been described as comprising three display digit channels 42, 44 and 46, it should be obvious that other numbers of display digit channels may also be employed without exceeding the spirit or scope of the invention. Thus, a three display digit channel system is useful for lottery number games which are based on three digit numbers. Four display digit channels may be used to provide a four digit number for use in a lottery game based on four digit numbers. The particular number of display digit channels is not limiting. However, whatever number of display digit channels is chosen, each display digit channel must be separately controlled by a manually operable switch (such as momentary pushbutton switches 36, 38 and 40) to practice the invention.

Preferably, each of the one shots 16, 48, 50 and 52 is a type Ser. No. 52,555 precision timer. The external capacitive and resistive elements (not shown) associated with each one shot are arranged in conventional manner to provide the T0, T1, T2 and T3 second pulse widths at the one shot outputs. Each of the NAND gates described above may be type Ser. No. 7400 positive NAND gates, the decade counters may be type 7490 decade counters; the latches may be type 7475 4-bit bistable latches; and the decoder/drivers may be type 7447 decoder/drivers.

As previously indicated, when the one shot 16 enables the switch operable, NAND gates 30, 32 and 34, it also enables NAND gate 28. The NAND gate 28 is connected to the blanking input BL of decoder/driver 26. The decoder/driver 26 controls a bank of led pairs 104. The led pairs may be arranged in a rectangular pattern and mounted on a housing (not shown) for the number generator 10.

Decoder/driver 26 may be a type 7447 BCD-to-7 segment decoder/driver. The 4-bit inputs of the decoder/driver 26 are connected to the 4-bit outputs of latch 76 in display digit channel 46. Alternatively, the inputs of the decoder/driver could be connected to the 4-bit outputs of latch 72 in channel 44 or the 4-bit outputs of latch 68 in channel 42, as will be apparent from the following description.

Assuming that the coin acceptor 12 has not yet received one or more coins of proper amount, decoder/driver 26 will decode the sequence of digital signals continously transmitted by latch 76. As a result, the decoder/driver 26 will operate particular combinations of the led pairs 104 to provide a pleasing visual effect of "flashing" lights based on the sequence of digital signals transmitted by latch 76.

When the proper amount of coins has been received by coin acceptor 12, the one shot 16 will enable NAND gate 28 for the T0 second time interval as previously described. When enabled, NAND gate 28 drives the blanking input BL of decoder/driver 26 to cause the decoder/driver to extinguish or hold all of the led pairs "off". This indicates to the operator that the T0 second time interval has begun and that the switches 36, 38 and 40 must be now operated within T0 seconds to select a number. When the T0 second interval expires, the led pairs 104 will resume "flashing" under control of the decoder/driver 26 to indicate to the operator that additional coins must be inserted in acceptor 12 to select a new number.

In addition to the foregoing, the generator 10 may be provided with a speaker 106 driven by an oscillator 108 which may be a type 556 dual timer connected in conventional fashion to produce an oscillating signal 110 which drives speaker 106 to produce a pleasing tone whenever switch 36, 38 or 40 is momentarily depressed.

In particular, the outputs of NAND gates 30, 33 and 34, designated A, B and C respectively, are connected to the inputs of NAND gates 112. Whenever a switch 36, 38 or 40 is depressed, the associated NAND gate output A, B or C will disable NAND gate 112. When disabled, NAND gate 112 applies a high voltage to the resistive leg 114 connected to speaker 106. This enables the speaker to produce an audible tone at the frequency of oscillator 108 for the brief period of time that the switch remains depressed.

It should be understood that although numeric displays are preferred in practicing the invention, other types of displays, such such as character displays, may also be used to display other than numeric indicia within the scope of the invention. Further, although the invention has been disclosed in connection with a coin acceptor for sensing the reception of one or more coins or proper amount, other condition detecting devices may also be employed within the scope of the invention; for example, the presence or absence of a card may be the condition detected instead of the reception of one or more coins.

The present invention may be embodied in other specific forms without departing from the spirit or essential attributes thereof and, accordingly, reference should be made to the appended claims, rather than to the foregoing specification, as indicating the scope of the invention.

I claim:

1. Apparatus, comprising:

at least one clock oscillator for generating a clock signal having a preselected repetition frequency, plural display channels associated with said clock oscillator, plural switches associated with said display channels, each of said switches being operatively associated with one of said display channels, each of said plural display channels comprising at least one counter for generating a sequence of digital signals at said preselected repretition frequency in response to said clock signal, display means for sequentially displaying indicia corresponding to said digital signals, at least one latch for transmitting said digital signals to said display means, and latch control means for generating a latch control pulse having a preselected time interval Ti in response to operation of the switch associated with the display channel for causing said latch to halt the sequential transmission of said digital signals to said display means at said preselected repetition frequency and to transmit only one of said digital signals to said display means for said preselected interval of time Ti following operation of said switch associated with the display channel and for causing said latch to resume transmitting said sequence of digital signals to said display means at the end of said preselected interval of time Ti, said preselected repetition frequency preventing visual recognition of individual indicia displayed by said display means at the preselected repetition frequency, said preselected interval of time Ti permitting visual recognition of individual indicia displayed by said display means during the preselected interval of Ti, and said switches and display channels being constructed and arranged such that operation of said switches in sequence causes said plural display channels to simultaneously display said visually recognizable individual indicia during the time that the latch control pulse generated in the display channel associated with the last operated switch and the latch control pulse generated in the display channel associated with the first operated switch overlap.

2. The apparatus according to claim 1 including condition detecting means for detecting a predetermined condition and for enabling said latch control means to cause said latch to halt the sequential transmission of said digital signals to said display means at said preselected repetition frequency in response to operation of the switch associated with the display channel for a preselected interval of time T0 when said predetermined condition is detected and for disabling said latch control means otherwise.

3. The apparatus according to claim 2 including plural light sources, means for successively actuating preselected combinations of said light sources when said condition is not detected and for extinguishing said light sources for said preselected interval of time T0 after said condition is detected.

4. The apparatus according to claim 1 wherein said latch control means comprises a one shot triggerable in response to operation of the switch associated with the display channel.

5. The apparatus according to claim 1 wherein said preselected repetition frequency is between approximately 10 KHz and 100 KHz.

6. The apparatus according to claim 1 wherein said display means comprises a numeric display.

7. The apparatus according to claim 1 including means for generating an audible tone in response to selective actuation of one or more of said switches.

8. Apparatus, comprising:

at least one clock oscillator for generating a clock signal having a preselected repetition frequency between approximately 10 KHz and 100 KHz, plural display channels associated with said clock oscillator, plural switches associated with said display channels, each of said switches being operatively associated with one of said display channels, each of said plural display channels comprising at least one counter for generating a sequence of digital signals at said preselected repretition frequency in response to said clock signal, display means for sequentially displaying indicia corresponding to said digital signals, at least one latch for transmitting said digital signals to said display means, and latch control means for generating a latch control pulse having a preselected time interval Ti in response to operation of the switch associated with the display channel for causing said latch to halt the sequential transmission of said digital signals to said display means at said preselected repetition frequency and to transmit only one of said digital signals to said display means for said preselected interval of time Ti following operation of said switch associated with the display channel and for causing said latch to resume transmitting said sequence of digital signals to said display means at the end of said preselected interval of time Ti, said preselected repetition frequency preventing visual recognition of individual indicia displayed by said display means at the preselected repetition frequency, said preselected interval of time Ti permitting visual recognition of individual indicia displayed by said display means during the preselected interval of time Ti, and said switches and display channels being constructed and arranged such that operation of said switches in sequence causes said plural display channels to simultaneously display said visually recognizable individual indicia during the time that the latch control pulse generated in the display channel associated with the last operated switch and the latch control pulse generated in the display channel associated with the first operated switch overlap, and condition detecting means for detecting a predetermined condition and for enabling said latch control means to cause said latch to halt the sequential transmission of said digital signals to said display means at said preselected frequency in response to operation of the switch associated with the display channel for a preselected interval of time T0 after said predetermined condition is detected and for disabling said latch control means otherwise.

9. The apparatus in accordance with claim 8 wherein said condition detecting means includes a coin acceptor mechanism.

10. The apparatus according to claim 8 including plural light sources, means for successively actuating preselected combinations of said light sources when said conditions is not detected and for extinguishing said light sources for said preselected interval of time T0 after said condition is detected.

11. The apparatus according to claim 8 including means for generating an audible tone in response to actuation of one or more of said switches.

12. A method, comprising:

generating at least one clock signal having a preselected repetition frequency, generating plural sequences of digital signals each at said preselected repetition frequency in response to said clock signal, displaying indicia corresponding to each of said plural sequences of digital signals at said preselected repetition frequency, said preselected repetition frequency preventing visual recognition of individual indicia, successively generating pulses having time intervals T1 and T2 respectively, successively halting the display of said indicia corresponding to one of said plural sequences of digital signals for a time interval T1 and the display of said indicia corresponding to another of said plural sequences of digital signals for a time interval T2, and displaying indicia corresponding to one of said digital signals of one of said plural sequences of digital signals and one of said digital signals of another of said plural sequences of digital signals during the time that said preselected intervals of time T1 and T2 overlap, said time during which said intervals T1 and T2 overlap permitting visual recognition of said indicia.

13. The method according to claim 12 including detecting a predetermined condition and preventing said step of selectively halting the display of indicia unless said step of selectively halting the display of indicia occurs within a preselected time interval T0 after detecting said predetermined condition.

14. The method according to claim 12 wherein said preselected intervals of time T1 and T2 are not the same.

* * * * *